US010317073B2

(12) United States Patent
Buelow et al.

(10) Patent No.: US 10,317,073 B2
(45) Date of Patent: Jun. 11, 2019

(54) FLOW THROUGH CYLINDRICAL BORES

(71) Applicant: Delavan Inc., West Des Moines, IA (US)

(72) Inventors: Philip E. O. Buelow, West Des Moines, IA (US); Jason Ryon, Carlisle, IA (US); Steve J. Myers, Norwalk, IA (US)

(73) Assignee: Delavan Inc., West Des Moines, IA (US)

( * ) Notice: Subject to any disclaimer, the term of this patent is extended or adjusted under 35 U.S.C. 154(b) by 710 days.

(21) Appl. No.: 13/714,270

(22) Filed: Dec. 13, 2012

(65) Prior Publication Data

US 2014/0166143 A1 Jun. 19, 2014

(51) Int. Cl.

| | |
|---|---|
| ***F23D 14/00*** | (2006.01) |
| ***F23D 14/58*** | (2006.01) |
| ***F23R 3/28*** | (2006.01) |
| ***F23D 11/10*** | (2006.01) |
| ***F23R 3/12*** | (2006.01) |
| *B05B 7/10* | (2006.01) |

(52) U.S. Cl.

CPC ..... *F23D 14/58* (2013.01); *F23D 11/107* (2013.01); *F23R 3/12* (2013.01); *F23R 3/28* (2013.01); *B05B 7/10* (2013.01); *Y10T 29/49996* (2015.01)

(58) Field of Classification Search

CPC ..... F23D 11/107; F23D 14/58; F05D 2260/14
USPC ..... 239/461–524, 427.5, 441; 60/737, 740, 60/748

See application file for complete search history.

(56) References Cited

U.S. PATENT DOCUMENTS

| | | | | |
|---|---|---|---|---|
| 2,928,611 | A * | 3/1960 | Lauderback ..... | A62C 31/005 239/439 |
| 2003/0080215 | A1 | 5/2003 | Hurley et al. | |
| 2012/0228405 | A1 | 9/2012 | Buelow et al. | |
| 2013/0200179 | A1 | 8/2013 | Buelow et al. | |

OTHER PUBLICATIONS

United Kingdom Search Report dated Jun. 11, 2014, issued on corresponding United Kingdom Patent Application No. GB 1322027.2.

* cited by examiner

*Primary Examiner* — Viet Le
(74) *Attorney, Agent, or Firm* — Locke Lord LLP; Scott D. Wofsy; Joshua L. Jones

(57) ABSTRACT

A flow directing apparatus for directing fluid flow includes a flow body defining a bore therethrough configured and adapted to direct fluid flowing therethrough. The bore includes an outlet and an opposed inlet with an enlargement, formed as a countersink and/or a chamfer using a suitable boring device. The enlargement is configured and adapted to reduce sensitivity to entrance-edge conditions for the bore.

12 Claims, 3 Drawing Sheets

Fig. 5
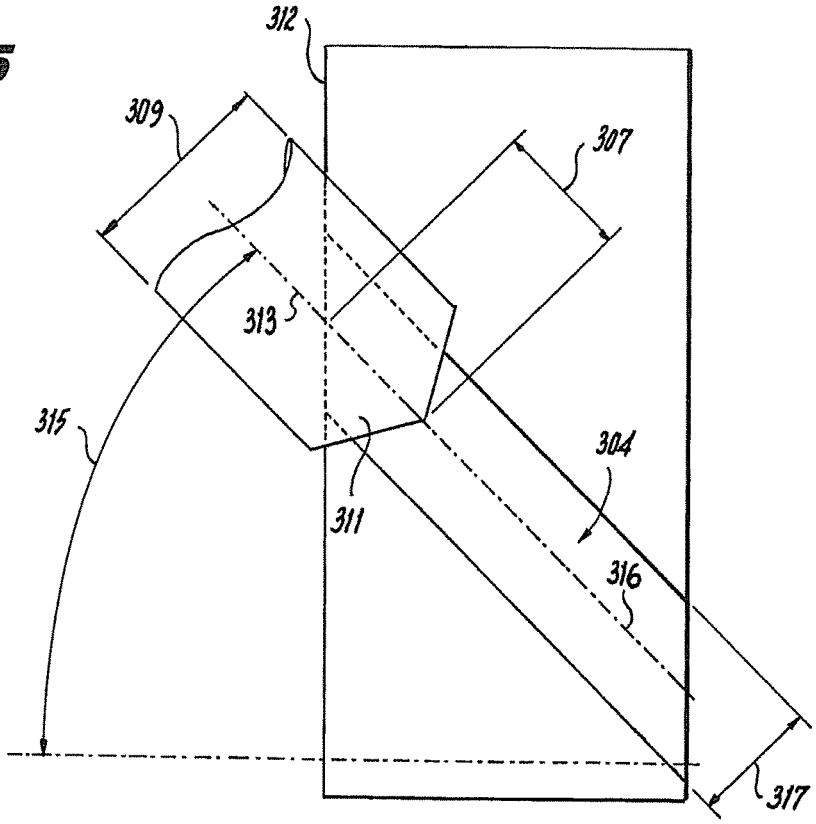
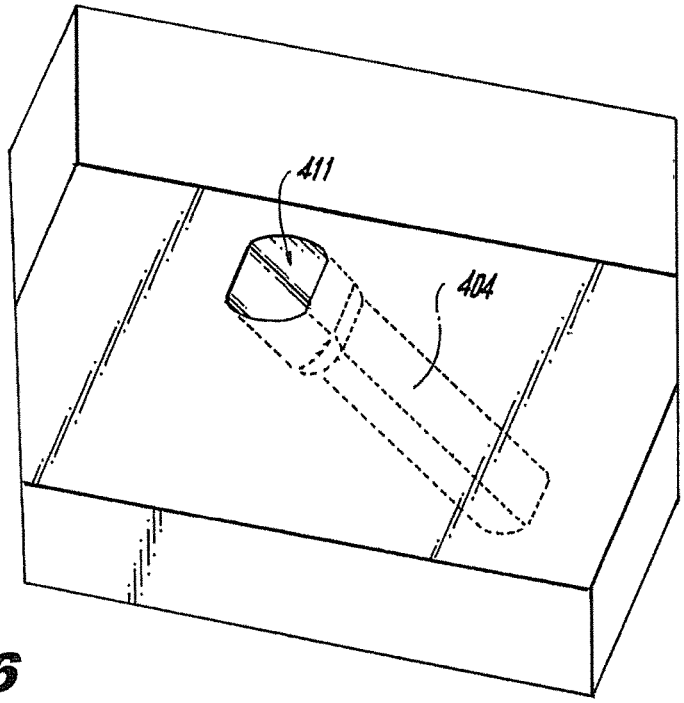
Fig. 6

FLOW THROUGH CYLINDRICAL BORES

BACKGROUND OF THE INVENTION

1. Field of the Invention

The present invention relates to devices and methods for imparting fluid flow through bores, and more particularly, to bores having entrance edge variation which effects flow-field behavior in various fluid-flow applications.

2. Description of Related Art

A flow directing apparatus which includes a bore for directing the fluid flow can be sensitive to variation in entrance edge conditions at a leading edge of the bore, and thus produce significant unwanted variation in flow-field behavior and flow rate. In addition, manufacturing processes can exacerbate variation in the entrance edge conditions. For example, deburring processes and tooling limitations in applications which require tight tolerances can impact a, bore's geometry at its leading edge, especially when the bore is drilled at an angle relative to a flat surface, or directly through convex or concave surfaces.

Conventional flow directing apparatuses and methods which utilize bores for metering and controlling fluid flow-field behavior have generally been considered satisfactory for their intended purpose. However, there is still a need in the art for improving the control and consistency of such metering and flow-field behavior.

SUMMARY OF THE INVENTION

A flow directing apparatus for directing fluid flow is provided along with a method for manufacturing the same. The flow directing apparatus includes a flow body defining a bore therethrough configured and adapted to direct fluid flowing therethrough. The bore includes an outlet and an opposed inlet with an enlargement configured and adapted to reduce sensitivity to entrance-edge conditions for the bore. In certain embodiments, the enlargement of the inlet includes at least one of a countersink having a larger cross-sectional area than that of the bore downstream of the countersink, and/or a chamfer having a depth corresponding to the square root of a cross-sectional area of the bore.

The flow body includes an inlet surface in which the inlet of the bore is defined, and an opposed outlet surface in which the outlet of the bore is defined. In certain embodiments, the bore can define a longitudinal axis that is angled relative to at least one of the inlet and outlet surfaces for imparting swirl to the fluid flowing therethrough.

In certain embodiments, the bore is cylindrical, and the enlargement of the inlet thereof includes the chamfer. The chamfer can be defined along a chamfer axis substantially perpendicular to the inlet surface, and can have a chamfer angle of about 45° relative to the inlet surface and/or the bore downstream of the chamfer. The chamfer can additionally or alternatively have a depth larger than about 15% of the bore diameter.

In certain embodiments, the enlargement of the inlet of the bore includes the countersink, and the countersink has a diameter between about 30% and about 75% greater than that of the bore downstream of the countersink. The countersink can have a depth sufficient to penetrate beyond the entire original entrance edge of the bore. The depth can be about 15% to about 100% of the diameter of the bore downstream of the countersink.

In accordance with certain embodiments, the flow body defines a plurality of bores between the inlet and outlet surfaces of the flow body. Each of the plurality of bores can be configured and adapted to impart swirl on a fluid flowing therethrough, and includes an outlet and an opposed inlet with an enlargement configured and adapted to reduce sensitivity to entrance-edge conditions for the bore. Each of the bores includes an enlargement as described above, and may be formed in accordance with any of the embodiments and features described above.

The invention also includes a method or process for forming a flow directing apparatus as described above. The method or process includes forming the bore through the flow body with the enlargement by forming at least one of a countersink and a chamfer in a blank.

In certain embodiments, the countersink is formed using a boring device selected from the group consisting of a ball-nosed end-mill, a flat end-mill, and a drill. The countersink can be created in the blank prior to formation of the bore downstream thereof using a ball-nosed end-mill with a diameter about 30% to about 75% greater than the diameter of the bore downstream of the countersink. In certain embodiments, the chamfer is formed using a chamfering bit after spot-facing the blank with an endmill and after forming the bore therethrough.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 5 is a schematic showing an exemplary embodiment of a countersink bore formed from a drill in accordance with the present invention.

FIG. 6 is a schematic showing an exemplary embodiment of a counter-bored slot formed from a ball-nose end mill in accordance with the present invention.

These and other features of the systems and methods of the subject invention will become more readily apparent to those skilled in the art from the following detailed description of the preferred embodiments taken in conjunction with the drawings.

DETAILED DESCRIPTION OF THE PREFERRED EMBODIMENTS

Figure 1:
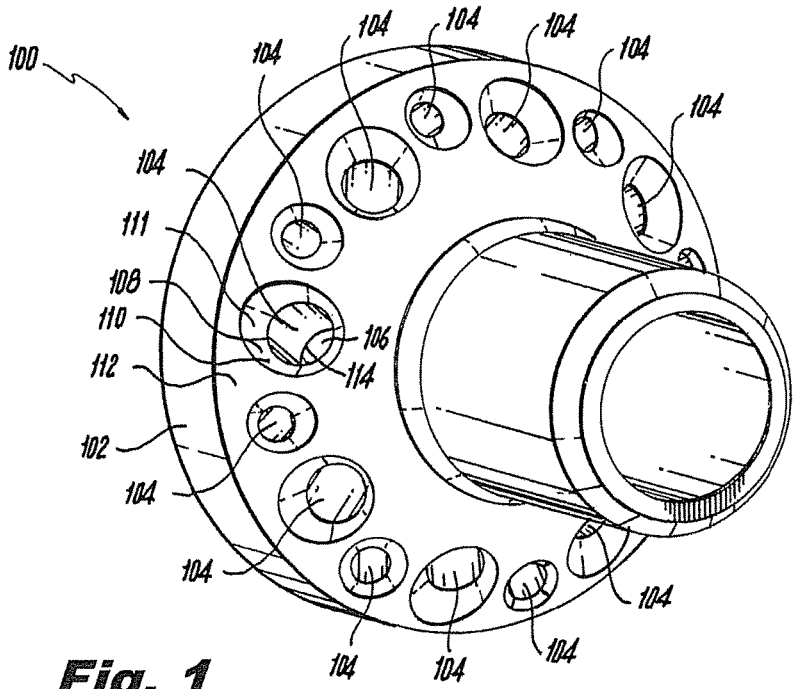
FIG. 1 is a perspective view of a flow directing apparatus for directing fluid flowing therethrough, constructed in accordance with an exemplary embodiment of the present invention and showing a flow body which defines a plurality of bores, each including a chamfer in the flow body.

Reference will now be made to the drawings wherein like reference numerals identify similar structural features or aspects of the subject invention. For purposes of explanation and illustration, and not limitation, a partial view of an exemplary embodiment of a flow directing apparatus in accordance with the invention is shown in FIG. 1, and is designated generally by reference character 100.

The flow directing apparatus 100 includes a flow body 102 defining a plurality of bores 104 therethrough. Each bore 104 includes an outlet 106 and an opposed inlet 108 with an enlargement 110 configured and adapted to reduce sensitivity to entrance-edge conditions for the bore 104. The flow body 102 includes an inlet surface 112 in which the inlet 108 of bore 104 is defined, and an opposed outlet surface 114 in which the outlet 106 of the bore 104 is defined. As shown, the enlargement 110 is formed as a chamfer 111 which has a larger cross-sectional area than that of the bore 104 downstream of the chamfer 111. The bores 104 are generally cylindrical in shape, and configured and adapted to impart swirl on a fluid flowing therethrough (e.g., for imparting swirl to air flowing in a gas turbine engine fuel injector). Bores of alternate shapes and/or which do not impart swirl may alternatively or additionally be utilized in other fuel systems or other applications in accordance with the present invention. Such applications include, for example, hydraulic equipment, medical devices such as insulin pumps and dialysis machines, plumbing, and food processing equipment. It will be appreciated by those skilled in the art that in most cylindrical-hole air swirlers on gas-turbine engines, the entrance shape of the cylindrical bores is not circular. Instead, an oblate shape is generally formed because the bores are usually not drilled perpendicular to the entrance surface. This geometry may make it difficult to form a radially constant chamfer size through the inlet surface 112. However, the critical portion of the edge of the bore 104 is the one where the fluid flow must turn the greatest degree (e.g., the most acute/sharp edge of the oblate shaped entrance to the cylindrical hole). This portion of the edge and the upstream portion of the cylindrical bore 104 (absent the chamfer 111) is shown in phantom in FIG. 2, further discussed below, at reference character 105. Examples of such structure are disclosed in U.S. patent application Ser. Nos. 13/368,659 and 13/481,411 (now U.S. Patent Pub. No. 2012/0228405), which are hereby incorporated by reference in their entireties. Edge portion 105 is the key portion of the edge of the initially cylindrical bore 104 for which the chamfer 110 must be defined and controlled to achieve the desired effects. The remainder of the entrance edge to the initially cylindrical bore 104 is generally less sensitive. The chamfer 111 can be created by using a chamfering bit 103 (FIG. 2) with proper orientation to achieve the desired chamfering effect.

Figure 2:
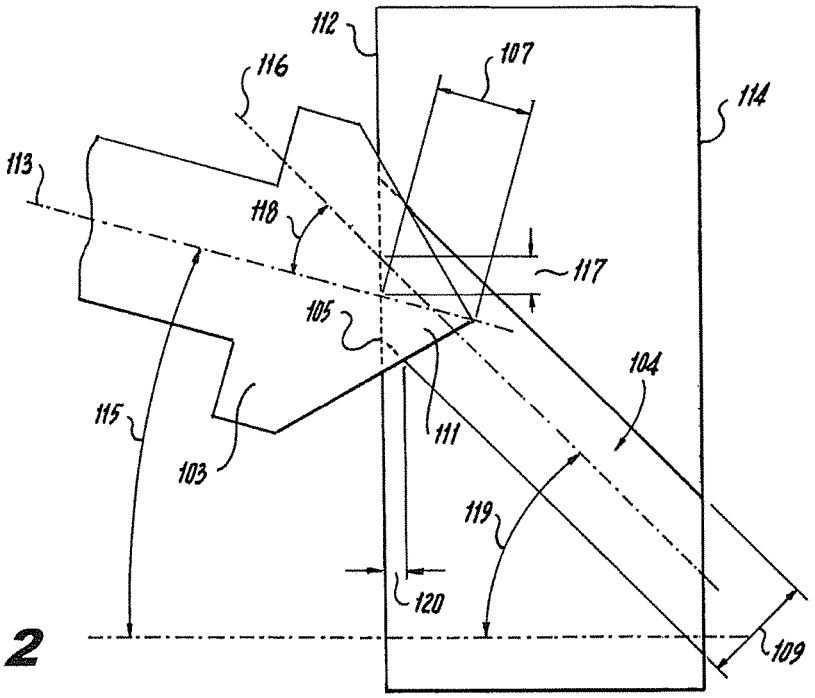
FIG. 2 is a schematic showing an exemplary embodiment of a chamfer in accordance with the present invention.

As shown schematically in FIG. 2, the chamfer 111 is formed along a chamfer axis 113 into the inlet surface 112, and thus eliminates the sharp edge 105 of the angled bore 104. The chamfer 111 and bore 104 can be formed in any order without departing from the scope of the invention, but the chamfer 111 will generally be formed after the bore 104 is formed. The chamfer 111 may be formed such that the chamfer angle 115 (relative to the normal of the inlet surface 112 of the flow body 102) is different than the bore angle 119. As shown, the chamfer angle 115 is less than the bore angle 119. In this case, the chamfer angle 115 is such that the relative angle 118 between the chamfer axis 113 and the bore axis 116 is about forty degrees, though other chamfer angles may be utilized. The chamfer 111 preferably has a depth 107 equal to or larger than about 15% of the diameter 109 of the bore 104, which renders it of sufficient size to substantially eliminate flow variation from bore to bore. The chamfer edge depth 120 is the depth of the edge-break on the acute-angle location of the entrance edge. The chamfer depth 107 is measured from the very tip of the chamfer bit to the inlet surface 112, along the chamfer axis 113. The chamfer edge depth 120 is measured from the inlet surface 112 along a normal thereto. The chamfer depth 107 and offset 117 are preferably adjusted such that the acute angled edge 105 of the original bore 104 is cut to a chamfer edge depth 120 of about 15% of the downstream bore diameter 109. If the bore angle 119 is 0°, then the chamfer angle 115 can be aligned with the bore angle 119. A chamfer edge depth 120 less than 15% may also be utilized, especially where surface geometry does not allow for depths larger than 15% on account of close proximity of entrance edges of multiple bores.

The discharge coefficient of air in the cylindrical bore varies less significantly once the depth of the chamfer exceeds 15% of the bore diameter downstream of the chamfer. For example, using a 0.031 inch diameter bore, the increase in discharge coefficient of air in the cylindrical bore varies minimally with the increase in chamfer depth once the chamfer depth is over 0.005 inches.

Continuing with FIG. 2, the bore 104 preferably defines a longitudinal axis 116 that is angled relative to the inlet surface 112 for imparting swirl to fluid flow through the bore 104. The bore 104 is also defined with the longitudinal axis 116 angled relative to the outlet surface 114. However, it is not necessary for the inlet surface 112 and the outlet surface 114 to be parallel as in the schematic in FIG. 2. It will be appreciated that for bores which are predominantly perpendicular to the entrance surface (e.g., inlet surface 112), the axis of the chamfering bit could be essentially aligned with the axis of the bore. Other chamfering angles and depths may be utilized.

Referring again to FIG. 1, the flow body 102 defines multiple bores 104 which extend from the inlet surface 112 to the outlet surface 114. The bores 104 can be configured with their respective inlets circumferentially arranged about the inlet surface 112 of the flow body 102, extending radially inward or outward through the flow body 102, to the outlet surface 114 of the flow body 102. It will be appreciated that each of the bores 104 is configured and adapted to impart swirl on a fluid flowing therethrough and to reduce sensitivity to entrance-edge conditions at the respective inlets thereof, and that the variation in flow number from one bore 104 to another is substantially eliminated.

Figure 3:
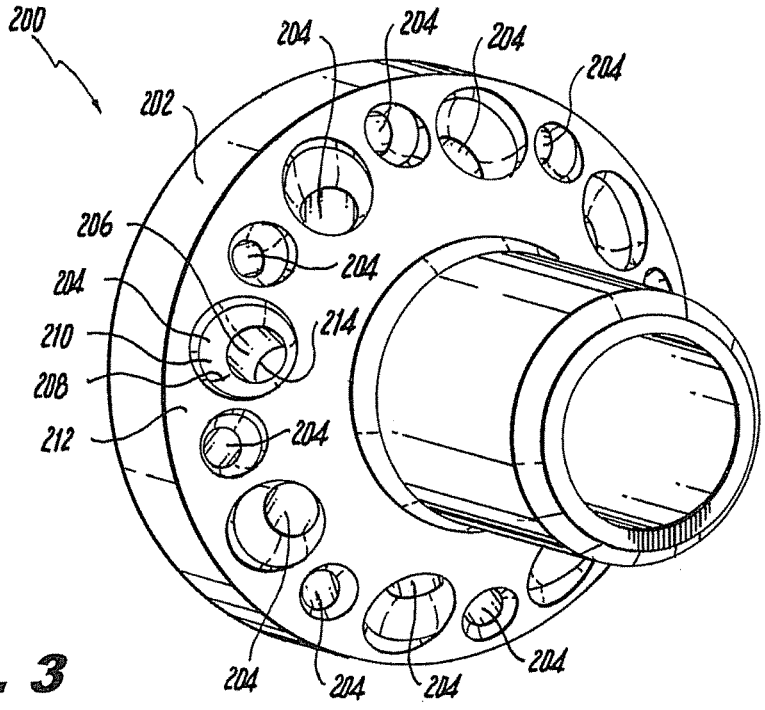
FIG. 3 is a perspective view of a flow directing apparatus for directing fluid flowing therethrough, constructed in accordance with another exemplary embodiment of the present invention, showing a flow body which defines a plurality of bores, each having a countersink in the inlet thereof.

With reference now to FIG. 3, a partial view of another exemplary embodiment of a flow directing apparatus in accordance with the invention is shown, and is designated generally by reference character 200. The flow directing apparatus 200 includes a flow body 202 defining a plurality of bores 204 therethrough configured and adapted to impart swirl on a fluid flowing therethrough. Each bore 204 includes an outlet 206 and an opposed inlet 208 with an enlargement 210 configured and adapted to reduce sensitivity to entrance-edge conditions for the bore 204. As shown, the enlargement 210 is formed as a countersink 211 which has a larger cross-sectional area than that of the bore 204 downstream of the countersink. The flow body 202 includes an inlet surface 212 in which the inlet 208 of the bore is defined, and an opposed outlet surface 214 in which the outlet 206 of the bore 204 is defined.

Figure 4:
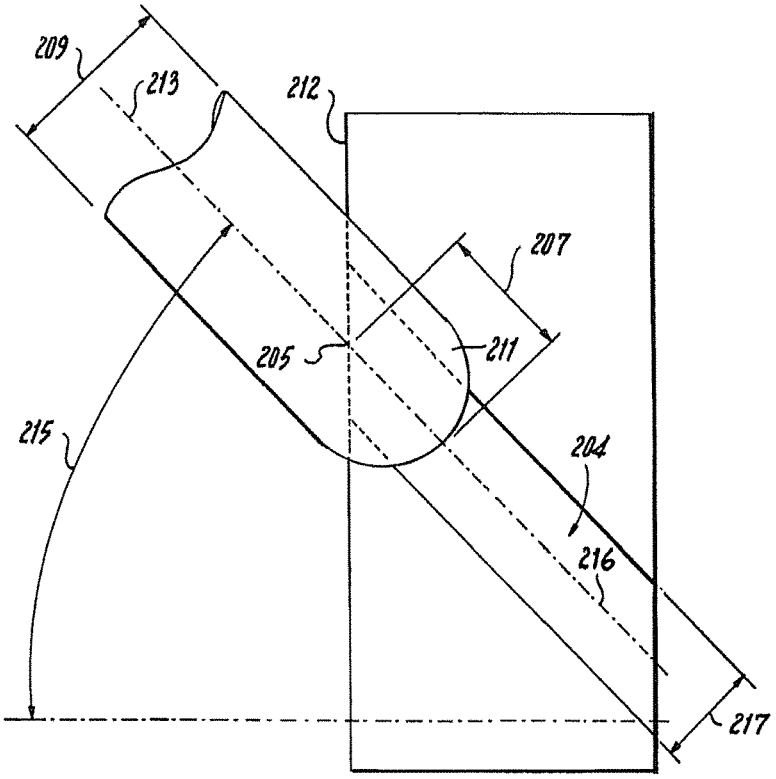
FIG. 4 is a schematic showing an exemplary embodiment of a countersink bore formed from a ball-nose endmill in accordance with the present invention.

Turning now to FIG. 4, a countersink 211 formed using a ball-nose endmill is shown. The countersink 211 can extend along a countersink axis 213 which is angled relative to the inlet surface 212, and substantially collinear with a longitudinal axis 216 of the bore 204. The endmill can alternatively be oriented at a different angle than the angle 215 of the downstream bore 204 to produce a countersink axis 213 oriented similar to chamfer axis 113 of FIG. 2 relative to the the bore axis. The countersink 211 preferably has a diameter 209 between about 30% and about 75% greater than that of the bore 204 downstream of the countersink 211. The countersink 211 can have a depth 207 anywhere between about 15% to about 100% of the diameter of the bore 204 downstream of the countersink 211, and provides the flow uniformity described above. The countersink depth 207 varies depending upon the angle 215 of the downstream bore 204 relative to the inlet surface 212. For example, the steeper the angle 215, the deeper the countersink depth 207. The countersink depth 207 is preferably large enough to alter the entire entrance edge of the original bore. As shown, the depth 207 is measured from the distal most end of the ball-nose to the inlet surface 212, along the countersink axis 213. For example, for a 0° bore angle 215, the countersink depth 207 can be about 15% of the downstream bore diameter 209. If the bore angle 215 is 60°, the countersink depth 207 can be about 100% of the downstream bore diameter 217. The countersink depth 207 is preferably sufficient to cut the acute angle edge (shown in phantom) of the original bore 204 by the ball-nose endmill to provide improved flow. The countersink 211 is preferably of sufficient diameter and depth to yield an effect similar to the chamfer described above, and effectively creates an aerodynamic chamfer. The countersink 211 can alternatively be formed using a flat end-mill, a drill, or any other suitable boring device.

Turning now to FIG. 5, a countersink 311 formed using a drill is shown. The countersink 311 extends along a countersink axis 313 which is angled relative to the inlet surface 312, and can be formed substantially collinear with a longitudinal axis 316 of the bore 304. The countersink axis 311 can alternatively be formed at an angle relative to the longitudinal axis 316 of the bore 304. The countersink 311 preferably has a diameter 309 between about 30% and about 75% greater than that of the bore 204 downstream of the countersink 311. The countersink 311 can have a depth 307 anywhere between about 15% to about 100% of the diameter of the bore 304 downstream of the countersink 311, and provides the flow uniformity described above. The countersink depth 307 varies depending upon the angle 315 of the downstream bore 304 relative to the inlet surface 312 as described above with respect to FIG. 4.

It has been determined by the inventors that a ball-nose end-mill, as opposed to a drill-point, yields a higher flow-rate and reduced flow sensitivity for a given end-mill size. Ball-nosed end-mills of diameter about 30%-75% greater than that of the bore can be used to increase the discharge coefficient by about 13%-23%. The inventors have found that a diameter ratio (ratio of end-mill diameter to bore diameter) of 1.6 yields better results than a diameter ratio of 1.3, and that a ball-nose end-mill with a 1.6 diameter ratio has a very low sensitivity to entrance-edge condition of the countersink. Similarly, drills of diameter of about 30%-75% greater than that of the bore can be used to increase the discharge coefficient by about 13%-20%.

It will be appreciated that by including some form of enlargement (e.g., chamfer or counter-sink) at the lead-in (e.g., the inlet surface), the variability in flow from bore to bore is greatly reduced, and has been found by the inventors to be less than about 5%, largely due to variations in edge-breaks leading into the counter-bores, for example.

Turning now to FIG. 6, a countersink 411 formed using a ball-nose end mill in accordance with the present invention is shown in conjunction with a bored slot 404. The slot 404 has a cross section with a substantially elongated rectangular or elliptical shape. Other shapes may be utilized. The countersink 411 is similarly shaped but with a larger cross section as described above.

While described above in the exemplary context of circular geometry, those skilled in the art will readily appreciate that non-circular geometries can also be used without departing from the scope of the invention. In the case of a non-circular bore, the desired depth of a particular enlargement will also be proportional to and correspond to the square root of a cross-sectional area of the bore downstream of the enlargement.

To form a flow directing apparatus as described in the above embodiments, initially, a blank (e.g., a part with no holes drilled in it) can be machined with a ball-nose counterbore (e.g., a countersink as described above) with a predetermined diameter and depth. The countersink can be followed with a cylindrical through-hole of specified size. The entrance and exit of the holes can be sufficiently deburred to remove visible burrs. The part may then be checked to determine whether the part functions in accordance with flow specifications. If not (e.g., if the flow rate is marginally low), the entrance to the counter-bore may be chamfered. Finally, the transition edge between the ball-nose formed countersink and the smaller cylindrical hole may be deburred/chamfered as needed for a given application.

To form the countersink 411 and slot 404 of FIG. 6, the countersink 411 is machined to a specified depth and then translated perpendicularly relative to its longitudinal axis. A smaller diameter drill/endmill is then utilized to form the downstream bore/slot 404 via similar longitudinal translation followed by perpendicular translation in the already-created countersink 411.

In certain embodiments, forming the enlargement includes forming the countersink in a flow directing apparatus blank using a ball-nosed end-mill with a diameter about 30% to about 75% greater than the diameter of the bore downstream of the countersink.

The methods and systems of the present invention, as described above and shown in the drawings, provide for improved flow directing apparatuses with superior properties including better control and consistency of flow-field behavior and flow rate through such flow directing apparatuses. It will readily be appreciated that liquid or gas flow may be used with the devices and teachings described above without departing from the spirit and scope of the invention.

While the apparatus and methods of the subject invention have been shown and described with reference to preferred embodiments, those skilled in the art will readily appreciate that changes and/or modifications may be made thereto without departing from the spirit and scope of the subject invention. For example, while particular shapes, sizes, dimensions, proportions, and orientations of bore holes, chamfers, and countersinks have been disclosed, it will be appreciated that other shapes, sizes, dimensions, proportions, and orientations may be utilized. It will also be appreciated that greater control and consistency of flow-field behavior and flow rate using the present invention may be achieved whether the fluid flow is gaseous, liquid, or both, and whether the application is for gas turbine fuel injectors or other technologies. Thus, it will be appreciated that changes may be made without departing from the spirit and scope as claimed.

What is claimed is:

1. A flow directing apparatus for a gas turbine engine for directing fluid flowing therethrough, comprising:

a flow body defining a bore therethrough configured and adapted to direct fluid flowing therethrough, wherein the bore includes an outlet and an opposed inlet with an enlargement configured and adapted to reduce sensitivity to entrance-edge conditions for the bore, wherein the enlargement of the inlet includes a countersink with a larger cross-sectional area than that of the bore downstream of the countersink, wherein the countersink has a depth of about 15% of the diameter of the bore where the bore angle is about 0° relative to the inlet surface.

2. The flow directing apparatus as recited in claim 1, wherein the flow body includes an inlet surface in which the inlet of the bore is defined, and an opposed outlet surface in which the outlet of the bore is defined, wherein the bore defines a longitudinal axis that is angled relative to at least one of the inlet and outlet surfaces for imparting swirl onto a fluid flow through the flow directing apparatus.

3. The flow directing apparatus as recited in claim 1, wherein the flow body includes an inlet surface in which the inlet of the bore is defined, and an opposed outlet surface in which the outlet of the bore is defined, wherein the bore defines a longitudinal axis that is angled relative to at least one of the inlet and outlet surfaces for imparting swirl onto a flow through the flow directing apparatus, and wherein the inlet of the bore includes a chamfer defined along a chamfer axis which extends traverse relative to the inlet surface and the longitudinal axis of the bore.

4. The flow directing apparatus of claim 1, wherein the enlargement of the inlet includes a countersink with a larger cross-sectional area than that of the bore downstream of the countersink.

5. The flow directing apparatus of claim 4, wherein the countersink has a diameter between about 30% and about 75% greater than that of the bore downstream of the countersink.

6. A flow directing apparatus for a gas turbine engine for directing fluid flowing therethrough, comprising:

a flow body defining an inlet surface and an opposed outlet surface with a plurality of bores defined through the flow body from the inlet surface to the outlet surface, wherein each bore is configured and adapted to direct fluid flowing therethrough and includes an outlet and an opposed inlet with an enlargement configured and adapted to reduce sensitivity to entrance-edge conditions for the bore, wherein the enlargement of the inlet includes a countersink with a larger cross-sectional area than that of the bore downstream of the countersink, wherein the countersink depth varies depending upon the an angle of the bore relative to the inlet surface, wherein at least one of the plurality of bores include a countersink having a depth of about 15% of the diameter of the bore where the bore angle is about 0° relative to the inlet surface.

7. The flow directing apparatus as recited in claim 6, wherein the enlargement of each inlet includes a chamfer that has a depth larger than about 15% of a diameter of the bore downstream of the chamfer.

8. The flow directing apparatus as recited in claim 6, wherein the flow body includes an inlet surface in which the inlet of each bore is defined, and an opposed outlet surface in which the outlet of each bore is defined, wherein each bore defines a longitudinal axis that is angled relative to at least one of the inlet and outlet surfaces for imparting swirl onto a fluid flow through the flow directing apparatus.

9. The flow directing apparatus as recited in claim 6, wherein the flow body includes an inlet surface in which the inlet of each bore is defined, and an opposed outlet surface in which the outlet of each bore is defined, wherein each bore defines a longitudinal axis that is angled relative to at least one of the inlet and outlet surfaces for imparting swirl to a fluid flow through the flow directing apparatus, and wherein the inlet of each bore includes a chamfer that is defined along a chamfer axis extending traverse relative to the inlet surface and the longitudinal axis of the bore.

10. The flow directing apparatus as recited in claim 6, wherein the enlargement of each inlet includes a countersink with a larger cross-sectional area than that of the bore downstream of the countersink, and wherein the countersink has a diameter between about 30% and about 75% greater than that of the bore downstream of the countersink.

11. The flow directing apparatus as recited in claim 6, wherein the enlargement of the each inlet includes a countersink with a larger cross-sectional area than that of the bore downstream of the countersink.

12. A flow directing apparatus for a gas turbine engine for directing fluid flowing therethrough, comprising:

a flow body defining a bore therethrough configured and adapted to direct fluid flowing therethrough, wherein the bore includes an outlet and an opposed inlet with an enlargement configured and adapted to reduce sensitivity to entrance-edge conditions for the bore, wherein the enlargement of the inlet includes a countersink with a larger cross-sectional area than that of the bore downstream of the countersink, wherein the countersink has a depth of about 100% of the diameter of the bore where the bore angle is about 60° relative to the inlet surface.

* * * * *